United States Patent [19]

Ernst

[11] Patent Number: 4,666,221

[45] Date of Patent: May 19, 1987

[54] MULTIDRAWER CABINET

[75] Inventor: Ronald E. Ernst, Port Washington, Wis.

[73] Assignee: Mayline Company, Inc., Sheboygan, Wis.

[21] Appl. No.: 847,938

[22] Filed: Apr. 3, 1986

[51] Int. Cl.[4] ..... A47B 88/14

[52] U.S. Cl. ..... 312/341 R; 312/330 R

[58] Field of Search ..... 312/341 R, 257 R, 330 R, 312/338, 270; 211/151, 162; 384/19

[56] References Cited

U.S. PATENT DOCUMENTS

| | | | |
|---|---|---|---|
| 1,244,609 | 10/1917 | Hood et al. | 312/257 R |
| 2,773,362 | 12/1956 | Scheitlin | 312/341 R |
| 2,860,929 | 11/1958 | Gussack | 384/19 |
| 2,898,159 | 8/1959 | Arnit | 384/19 |
| 3,164,419 | 1/1965 | Michaelson | 384/18 |
| 3,181,925 | 5/1965 | Fischer | 312/339 |
| 3,222,117 | 12/1965 | Schwartz | 312/350 X |
| 3,261,647 | 7/1966 | Stewart | 384/19 |
| 3,926,491 | 12/1975 | Greer | 312/330 R |
| 4,121,876 | 10/1978 | Ratti | 384/19 |
| 4,138,175 | 2/1979 | Tattershall | 312/341 R X |

FOREIGN PATENT DOCUMENTS

| | | | |
|---|---|---|---|
| 88702 | 6/1958 | Netherlands | 312/338 |

*Primary Examiner*—Kenneth J. Dorner
*Assistant Examiner*—Joseph Falk
*Attorney, Agent, or Firm*—Irwin C. Alter

[57] ABSTRACT

A cabinet with a plurality of stacked drawers has an outer frame and a plurality of first track members carried on opposed inner walls of the frame. Each first track member defines a pair of inwardly extending, spaced arms. A plurality of drawers carry at least one roller on each lateral side, with the rollers resting on an inwardly extending arm so that the rollers of each drawer roll along the arm in which they rest as the drawer is opened and closed. There are more drawers present than track members on either of the inner walls, which provide an economy of weight as well as improved function. Additionally, a novel drawer slide structure is shown in which the first track members may have at least one arm which defines a longitudinally extending, convex rib on which the drawer rollers travel, for improved operation over other designs.

12 Claims, 3 Drawing Figures

MULTIDRAWER CABINET

BACKGROUND OF THE INVENTION

This application relates to improvements in multiple drawer cabinets, which may include industrial cabinets such as 10-drawer blueprint cabinets, or any other kind of structures which include, typically, multiple drawers. For example, household cabinets and decorative bureaus may utilize the application of this invention, as well as industrial or commercial items. Also, in certain circumstances, an aspect of the invention of this application may be used in a single drawer structure.

By use of this invention, a superior drawer movement may be provided, when compared with conventional offset or flat track drawer movement designs. Additionally, the use of this invention can provide a reduction in weight in the entire drawer movement for multiple drawer systems, for example, the 10-drawer file system for blueprints or the like as described above. Accordingly, the invention of this application can be used to provide a cabinet which is of reduced cost due to the reduced material involved in the manufacture of its drawer movements, reduced weight for greater convenience in moving, and drawers that open and close more easily, smoothly, and quietly than prior art designs.

DESCRIPTION OF THE INVENTION

In accordance with this invention, a cabinet is provided which typically carries a plurality of stacked drawers. The cabinet includes an outer frame, and a plurality of first track members carried on each of a pair of opposed inner walls of the frame, positioned in the direction of drawer movement. The track members on each inner wall are disposed in vertically spaced, horizontally extending, parallel array, and at equal heights to their counterparts on the opposed inner wall, as of course is usual and conventional in drawer movement technology.

In this invention, each first track member defines a pair of inwardly extending, spaced arms. A plurality of drawers present carry at least one roller on each lateral side thereof, the rollers each resting on an inwardly extending arm. As a result of this, the rollers of each drawer can roll along the arm on which they rest as the drawer is opened and closed.

By this invention, there can be more drawers present than track members on either of the inner walls. This results in a significant reduction in the weight of the track members present which, of course, reduces the overall weight of the cabinet, and generally the first track members used in this invention can be less expensive overall than corresponding prior art track members.

Preferably, the arms of the first track members define a longitudinally extending, convex rib upon which the drawer rollers travel. This has been found to provide a far superior drawer movement, when compared with conventional offset, or flat track, designs.

As a further preferred feature, added rollers are mounted on the opposed inner walls, with the drawers each carrying second track members which rest on at least one added roller mounted on each opposed, inner wall, to further facilitate drawer opening and closing. The second track members may each define a longitudinally extending, concave rib that receives its added roller and provides further advantageous drawer movement.

As the result of this novel structure, the cabinet may carry twice as many drawers as there are first track members on one of the opposed, inner walls. This provides a great convenience in manufacturing efficiency as well as manufacturing cost. Also, as stated before, a net reduction in the weight of the cabinet can be achieved by this invention.

If desired, the feature described above of a track member having a generally horizontal arm which defines a longitudinally extending, convex rib may be used in other drawer designs than those described above. Such a rib provides inherently good drawer movement by use of a roller which rests and rolls on such a convex rib. The track members may be carried by either opposed inner walls of the frame or, alternatively, they may be carried by the drawer. The rollers, then, are naturally carried by the other of the two members.

In this circumstance, it may still be desirable to use the added rollers, and the second track members which rest on at least one added roller. Preferably the second track members will be positioned oppositely to the first track members; i.e. if the first track members are carried on the inner walls of the cabinet, the second track members will be carried on the facing edges of the drawer. If the first track members are carried on the drawer, the second track members should generally be carried by the cabinet. The added rollers are of course positioned oppositely to the second track members so that the second track members can roll along the added rollers as the first rollers roll along the first track members.

Accordingly, improvements in drawer design are provided by the invention of this application, having advantages as described above.

DESCRIPTION OF THE DRAWINGS

Referring to the drawings.

DESCRIPTION OF SPECIFIC EMBODIMENT

Figure 1:
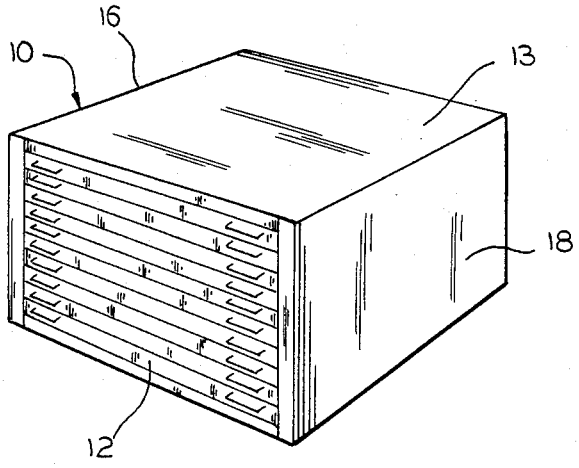
FIG. 1 is a perspective view of a ten drawer cabinet, making use of the invention of this application.
Figure 2:
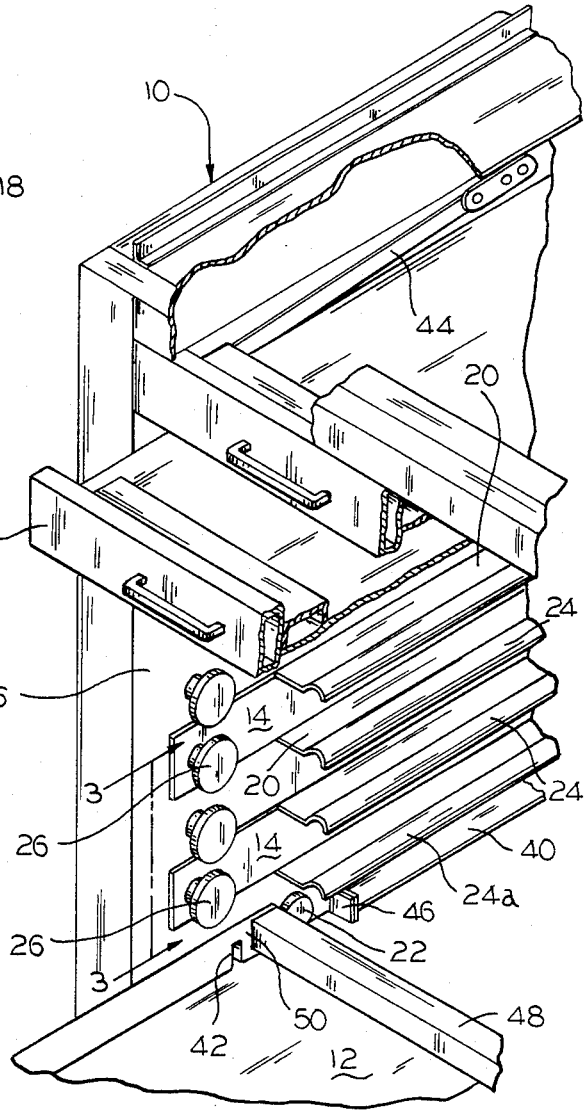
FIG. 2 is a broken away enlarged perspective view of the cabinet of FIG. 1.
Figure 3:
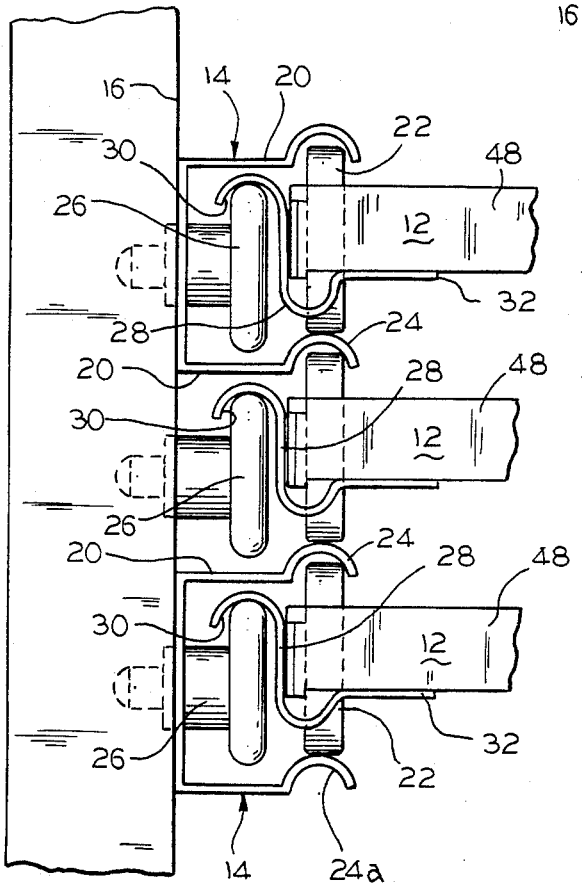
FIG. 3 is a sectional view taken along line 3—3 of FIG. 2.

Referring to the drawings, FIG. 1 shows cabinet 10 having a multiplicity of drawers 12 which make use of the drawer slide invention of this application. Cabinet 10 defines an outer frame 13, the inner walls which carry a plurality of first track members 14 on each of a pair of opposed inner walls 16, 18. The views of FIGS. 2 through 4 show the structure as it exists on inner wall 16. The corresponding structure carried on the interior of wall 18 is identical and corresponding to that shown in FIGS. 2 and 3.

As shown, first track members 14 on each inner wall are disposed and vertically spaced in horizontally extending, parallel array, and at equal heights to their counterparts on opposed inner wall 18.

Each first track member defines a pair of inwardly extending, spaced arms 20.

Drawers 12 carry at least one roller 22 on each lateral side thereof. Each of rollers 22 rest on an inwardly extending arm 20, so that the rollers of each drawer 12 can roll along the arm on which they rest as the drawer is opened and closed.

By this invention, there can be more drawers 12 present than track members 14 on each of the inner walls, for saving of weight in the cabinet, along with improved function. For example, in the specific embodiment shown, there may be ten drawers 12 for every five track members 14 on either of said opposed inner walls 16 or 18, i.e., twice as many.

Arms 20 may each define a longitudinally extending, convex rib 24 upon which the drawer rollers 22 travel. It has been found that improved smoothness of movement and reliability is provided to the drawer movement when such a convex rib is provided for a track of a roller such as roller 22.

Added rollers 26 are mounted on opposed inner wall 16 as shown in FIGS. 2 and 3, with similar structure being found on inner wall 18. Each drawer 12 carries a second track member 28, with track members 28 resting on added rollers 26 on the respective inner walls 16, 18. Specifically, second track members 18 each define a longitudinally extending, concave rib 30 (from the viewpoint of roller 26) that receives roller 26, as shown, on both sides of each drawer 12. In the vicinity of both inner walls 16, 18 each second track member 28 may carry an extension 32 which is glued or otherwise sealed to the underside of drawer 12 as shown, for proper securance of the second track member to drawer 12. Second track members 28 may also be glued or otherwise sealed to the lateral sides of drawer 12, as well.

In FIG. 2, many of the parts of the drawer system of this invention are removed for clarity of disclosure. Roller 22 shown therein is attached to the particular drawer 12 that is shown, running underneath the particular rib 24*a* as shown and riding on a bottom, flat rib 40 underneath roller 22. Rib 24*a* is for supporting the roller 22 of the next drawer up, which drawer is eliminated from FIG. 2 for purposes of disclosure. Also, ribs 24 may serve as an upper guide for roller 22 below it, so as each drawer 12 is opened, roller 22 will be guided and supported by the ribs 24 above and below it. A little clearance is provided between the spaced ribs 24 for each roller 22, so that roller 22 will tend to be in contact with only one of the ribs 24, above or below it, depending upon the angular position of the drawer as it is withdrawn and the like. Similarly, clearance is provided for bottom roller 22 between flat rib 40 and the bottom, curved rib 24*a*.

In the drawer itself, clip member 42 is a conventional device for securing a dust cover for protection of the contents of the drawer, for example blueprints. In the front of each drawer 12, pivoting arm 44 secures the front of the dust cover in conventional manner, permitting it to be raised for insertion or withdrawal of blueprints or other documents. Similar structure is provided on the other lateral side of each drawer 12.

It can be seen that each wheel 22 rides rearwardly of cross-bar 48 of drawer 12, being attached to lateral side 50 of the drawer. Each lateral side 50 also carries rear stop member 46, positioned to serve as a bumper against the rear wall of the file cabinet, to protect roller 22 from damage.

Accordingly, a sliding drawer system is disclosed which is preferably used in a multiple drawer cabinet or the like. The system exhibits reduction in weight and complexity when compared with prior art sliding drawer systems, as well as providing improved performance when compared with previous designs.

The above has been offered for illustrative purposes only, and is not intended to limit the scope of the invention of this application, which is as defined in the claims below.

That which is claimed is:

1. In a cabinet which carries a plurality of stacked drawers, an outer frame carrying opposed inner walls, a plurality of first track members carried on each of said pair of opposed inner walls of said frame, said first track members on each inner wall being disposed in vertically spaced, horizontally extending, parallel array, and at equal heights to said first track members on the opposed inner wall, each first track member defining a pair of inwardly extending, spaced arms; a plurality of drawers carrying at least one roller on each lateral side thereof, said rollers each resting on an inwardly extending arm, whereby the rollers of each drawer can roll along the arm on which they rest as the drawer is opened and closed, there being more drawers present and operatively engaging said track members with their rollers than there are track members on either side of said inner walls;

said arms each defining a longitudinally positioned, upwardly facing convex rib of arcuate cross-section upon which a roller of a drawer rests, the convex ribs each defining corresponding downwardly facing, longitudinally positioned grooves, upper portions of said rollers each extending into a groove of an arm to serve as an upper guide for said rollers.

2. The cabinet of claim 1 in which said arms define a longitudinally upwardly facing extending, convex rib upon which the drawer rollers travel.

3. Ihe cabinet of claim 1 in which added rollers are mounted on said opposed, inner walls, said drawers each carrying second track members which rest on at least one added roller mounted on each opposed, inner wall, to further facilitate drawer opening and closing.

4. The cabinet of claim 3 in which said second track members each define a longitudinally extending, concave rib that receives its added roller.

5. The cabinet of claim 1 which carries twice as many drawers as there are first track members on one of said opposed, inner walls.

6. In a cabinet which carries a plurality of stacked drawers, an outer frame carrying opposed inner walls, a plurality of first track members carried on each of said pair of opposed inner walls of said frame, said first track members on each wall being disposed in vertically spaced, horizontally extending, parallel array and at equal heights to said first track members on the opposed inner wall, each first track member defining a pair of inwardly extending, spaced arms; a plurality of drawers carrying at least one roller on each lateral side thereof, said rollers each resting on an inwardly extending arm, thereby the rollers of each drawer can roll along the arm on which they rest as the drawer, is opened and closed, there being more drawers present and operatively engaging said track members through said rollers than there are first track members on either of said inner walls, said arms each defining a longitudinally positioned, upwardly facing, convex rib of arcuate cross-section upon which the drawer rollers travel, the convex ribs each defining corresponding downwardly facing, longitudinally positioned grooves, upper portions of said rollers each extending into a groove of an arm to serve as an upper guide for said rollers, and added rollers mounted on said opposed, inner walls, said drawers each carrying second track members which respectively rest on at least one of added rollers mounted on each opposed inner wall, to further drawer opening and closing.

7. The cabinet of claim 6 in which said second track members each define a concave rib that receives its added roller.

8. The cabinet of claim 7 which carries twice as many drawers as there are first track members on one of said opposed inner wall.

9. In a drawer movement permitting smooth motion of a drawer into and out of a retaining frame, a pair of first track members carried on said frame and disposed in parallel array, and arm means carried on said track member, said arm means each defining a longitudinally extending, convex rib; rollers positioned to rest and roll on each longitudinally extending, convex rib, said first track members being carried by one of (a) opposed walls of an outer frame and (b) opposed sides of a drawer, and said rollers being carried by the other of said opposed walls of an outer frame and opposed sides of a drawer, the convex ribs of the arms means being longitudinally positioned, upwardly facing, and of arcuate cross-section with said rollers resting upon said convex ribs, the convex ribs defining corresponding downwardly facing, longitudinally positioned grooves, upper portions of said rollers each extending into a groove of an arm to serve as an upper guide for said rollers.

10. The cabinet of claim 9 in which added rollers are mounted on the one member of said opposed walls of the outer frame and opposed drawer sides which carries said first track member, the other of said members carrying second track members which rest on said added rollers, to further facilitate drawer opening and closing.

11. The cabinet of claim 10 in which said second track members each define a longitudinally extending, concave rib which receives its added roller.

12. The cabinet of claim 9 in which at least some of said rollers extend into a groove defined in the rear side of convex rib means of arm means positioned above said rollers, to serve as an upper guide for said rollers.

* * * * *

UNITED STATES PATENT AND TRADEMARK OFFICE

CERTIFICATE OF CORRECTION

PATENT NO. : 4,666,221

DATED : May 19, 1987

INVENTOR(S) : Ronald E. Ernst

It is certified that error appears in the above-identified patent and that said Letters Patent are hereby corrected as shown below:

| | |
|---|---|
| Col. 2, line 54 | Change "4", should be --3--. |
| Col. 4, line 32 | Change "Ihe", should be --The--. |
| Col. 4, line 54 | Change "thereby", should be --whereby--. |
| Col. 4, line 55 | Change "drawer,", should be --drawer--. |
| Col. 5, line 1 | After the word "further" insert --facilitate--. |

Signed and Sealed this

Fifteenth Day of September, 1987

*Attest:*

DONALD J. QUIGG

*Attesting Officer*

*Commissioner of Patents and Trademarks*